US009022128B2

(12) United States Patent
Efthymiou et al.

(10) Patent No.: US 9,022,128 B2
(45) Date of Patent: May 5, 2015

(54) WATER INTAKE RISER ASSEMBLY FOR AN OFF-SHORE STRUCTURE, AND METHOD OF PRODUCING A LIQUEFIED HYDROCARBON STREAM AND METHOD OF PRODUCING A VAPOROUS HYDROCARBON STREAM

(75) Inventors: Michalakis Efthymiou, Rijswijk (NL); Guido Leon Kuiper, Rijswijk (NL); Herman Theodoor Van Der Meyden, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/988,066

(22) PCT Filed: Nov. 16, 2011

(86) PCT No.: PCT/EP2011/070260

§ 371 (c)(1), (2), (4) Date: May 17, 2013

(87) PCT Pub. No.: WO2012/066039

PCT Pub. Date: May 24, 2012

(65) Prior Publication Data

US 2013/0239480 A1 Sep. 19, 2013

(30) Foreign Application Priority Data

Nov. 18, 2010 (EP) ..... 10306273

(51) Int. Cl.
*E21B 7/12* (2006.01)
*E21B 17/01* (2006.01)
(Continued)

(52) U.S. Cl.
CPC . *E21B 17/01* (2013.01); *B63J 2/12* (2013.01); *F25J 1/0022* (2013.01); *F25J 1/0278* (2013.01); *F25J 1/0297* (2013.01); *B63B 13/00* (2013.01); *B63B 2035/4473* (2013.01)

(58) Field of Classification Search
CPC ..... E21B 17/01; E21B 19/004
USPC ..... 166/367; 405/224.2
See application file for complete search history.

(56) References Cited

U.S. PATENT DOCUMENTS 3,369,511 A 2/1968 German
3,872,679 A * 3/1975 Fischer ..... 405/200
(Continued)

FOREIGN PATENT DOCUMENTS

CN 101585400 11/2009
CN 101672593 3/2010 ..... F28D 15/02
(Continued)

OTHER PUBLICATIONS

PCT International Search Report, Application No. PCT/EP2011/070260 dated Dec. 14, 2011.

*Primary Examiner* — Matthew Buck
*Assistant Examiner* — Aaron Lembo

(57) ABSTRACT

A water intake assembly (105) is suspendable from an off-shore structure (102) is proposed. It has a bundle (106) of at least a first tubular conduit (106A) and a second tubular conduit (106B) generally stretching side by side along a length direction. At least a part of the distal portion (109) of the first tubular conduit extends further in the length direction than the second tubular conduit when in fully suspended condition. Described used of such a water intake riser assembly include: a method of producing a liquefied hydrocarbon stream and a method of producing a vaporous hydrocarbon steam.

12 Claims, 2 Drawing Sheets

Figure 1:
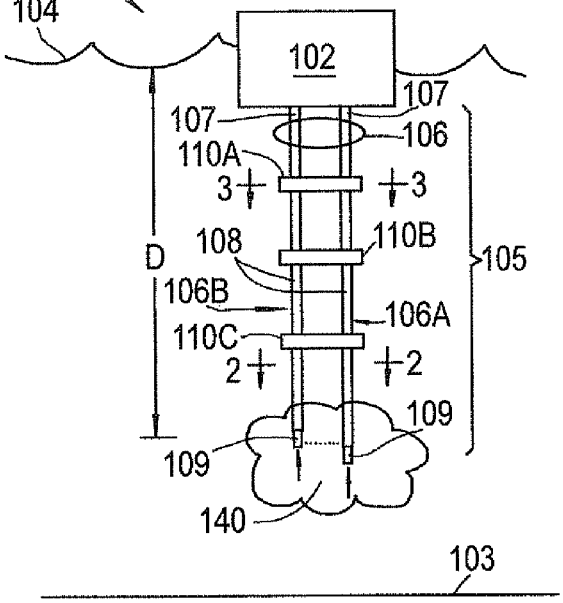

(51) Int. Cl.

| | |
|---|---|
| ***B63J 2/12*** | (2006.01) |
| ***F25J 1/00*** | (2006.01) |
| ***F25J 1/02*** | (2006.01) |
| *B63B 13/00* | (2006.01) |
| *B63B 35/44* | (2006.01) |

(56) References Cited

U.S. PATENT DOCUMENTS

| | | | | |
|---|---|---|---|---|
| 4,142,584 | A | 3/1979 | Brewer et al. | |
| 4,472,083 | A * | 9/1984 | Younes | 405/196 |
| 6,673,249 | B2 * | 1/2004 | Max | 210/747.5 |
| 7,318,387 | B2 | 1/2008 | Cox et al. | |
| 8,444,182 | B2 * | 5/2013 | Kuo et al. | 285/114 |
| 2003/0005698 | A1 | 1/2003 | Keller | |
| 2003/0159800 | A1 * | 8/2003 | Nierenberg | 165/41 |

FOREIGN PATENT DOCUMENTS

| | | | |
|---|---|---|---|
| FR | 2029224 | 1/1969 | |
| JP | 8188785 | 7/1996 | C10L 3/06 |
| WO | 03006783 | 1/2003 | |
| WO | WO03104605 | 12/2003 | E21B 17/01 |
| WO | WO2004085238 | 10/2004 | B63B 27/24 |
| WO | 20050543034 | 5/2005 | |
| WO | 20050545143 | 5/2005 | |
| WO | WO2008022119 | 2/2008 | B63B 35/44 |
| WO | 2009007439 | 1/2009 | |
| WO | WO2010085302 | 7/2010 | F15D 1/10 |

* cited by examiner

WATER INTAKE RISER ASSEMBLY FOR AN OFF-SHORE STRUCTURE, AND METHOD OF PRODUCING A LIQUEFIED HYDROCARBON STREAM AND METHOD OF PRODUCING A VAPOROUS HYDROCARBON STREAM

PRIORITY CLAIM

The present application claims priority from PCT/EP2011/070260, filed Nov. 16, 2011, which claims priority from European application 10306273.3, filed Nov. 18, 2010, which is incorporated herein by reference.

The present invention relates to a water intake riser assembly that is suspendable from an off-shore structure and/or an off-shore structure from which a water riser assembly according to any one of the preceding claims is suspended. In other aspects, the invention relates to a method of producing a liquefied hydrocarbon stream employing such a water intake riser assembly and/or a of producing a vaporous hydrocarbon stream employing such a water intake riser assembly.

WO 2010/085302 discloses a marine system including a Floating Liquefied Natural Gas (FLNG) plant on/in a surface of the ocean. The FLNG plant may cool and liquefy natural gas to form LNG, or alternatively heat and gasify LNG. A water riser assembly is suspended from the FLNG plant to take in cold water at depth and convey the cold water upward to the FLNG plant. The water riser assembly comprises tubular structures projecting downwardly into the ocean and connected together with a plurality of spacers. The spacers have openings through which respective ones of the tubular structures are disposed. One or more tubular structures of an array or grouping connected with FLNG plant may be used to bring water from the ocean to the plant. In one example nine tubular structures are arranged in a three-by-three rectangular array and filters are provided on each of the bottoms of the tubular structures. If one of the filters clogs over time, the remaining tubuler structures may still convey sufficient water to the FLNG plant.

However, it should preferably be avoided that all tubes clog at the same time. Moreover, the known array of tubular structures may cause an undesirable combined effect on the water flow field as it is being taken in from the ocean.

In a first aspect, the present invention provides a water intake riser assembly that is suspendable from an off-shore structure, comprising a bundle of at least a first tubular conduit and a second tubular conduit generally stretching side by side along a length direction, each comprising, seen in the length direction, a proximal portion comprising suspension means, followed by a connecting portion, followed by a distal portion comprising a water-intake section, said distal portion extending between a first distal end and the connecting portion of the respective tubular conduit, said connecting portion fluidly connecting the proximal portion and the distal portion, the first and second tubular conduits being laterally connected to each other by means of at least one spacer cooperating with the respective connecting portions, wherein at least a part of the distal portion of the first tubular conduit extends further in the length direction than the second tubular conduit when in fully suspended condition.

Such a water riser assembly may be suspended from an off-shore structure to form an off-shore structure from which such a water riser assembly is suspended.

In another aspects, the present invention provides a method of producing a liquefied hydrocarbon stream employing such a water intake riser assembly and a method of producing a vaporous hydrocarbon stream employing such a water intake riser assembly.

The method producing a liquefied hydrocarbon stream comprises:

feeding a vaporous hydrocarbon containing feed stream to an off-shore structure;

forming a liquefied hydrocarbon stream from at least a part of the vaporous hydrocarbon containing feed stream comprising at least extracting heat from at least said part of the vaporous hydrocarbon containing feed stream;

supplying water to the off-shore structure via the water intake riser;

adding at least part of the heat removed from said at least a part of the hydrocarbon containing feed stream to at least part of the water supplied via the water intake riser assembly;

subsequently disposing of the at least part of the water.

The method of producing the vaporous hydrocarbon stream comprises:

providing a liquefied hydrocarbon stream on an off-shore structure;

forming a vaporous hydrocarbon stream from at least a part of the liquefied hydrocarbon stream comprising adding heat to the said part of the liquefied hydrocarbon stream;

supplying water to the off-shore structure via the water intake riser assembly;

drawing at least part of the heat for adding to the said part of the liquefied hydrocarbon stream from at least part of the water supplied via the water intake riser assembly;

subsequently disposing of the at least part of the water.

Figure 2:
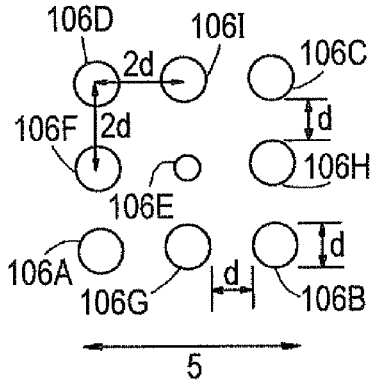
Figure 3:
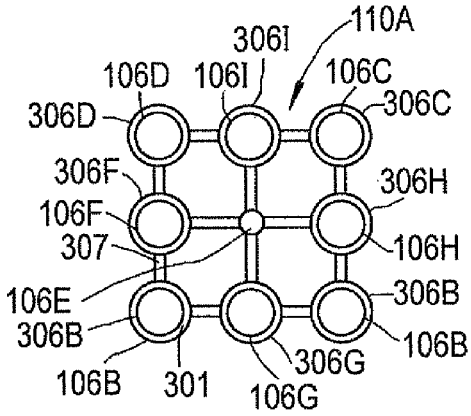
Figure 3A:
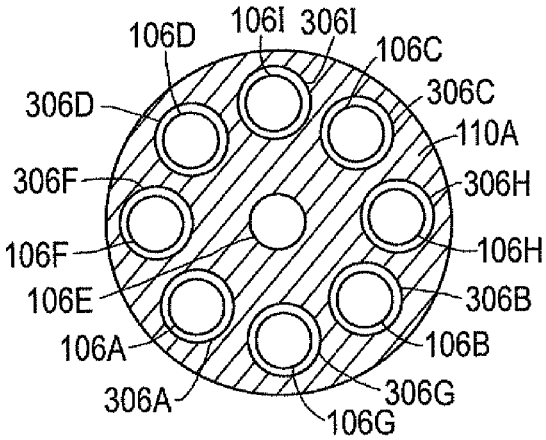
Figure 4:
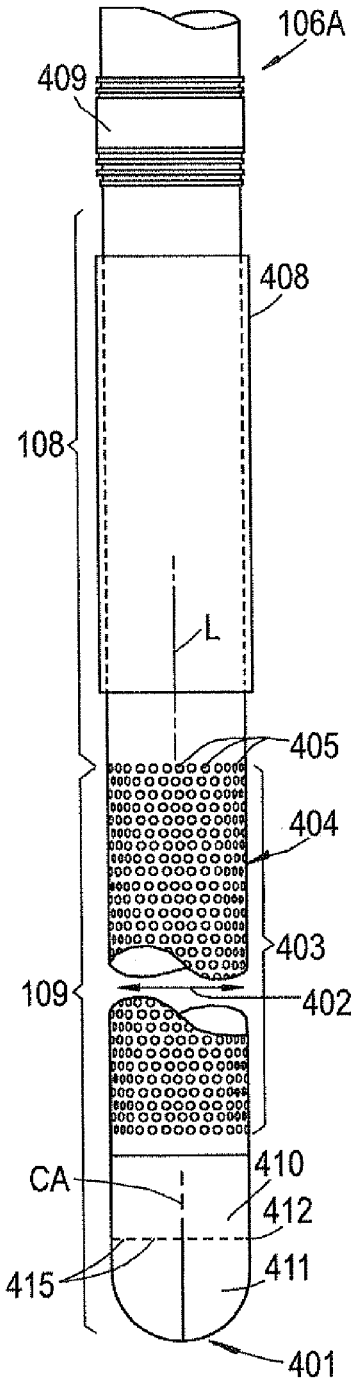
Figure 5:
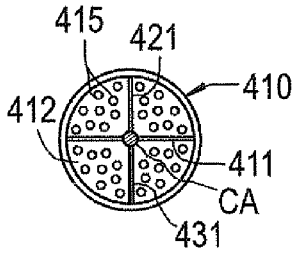
Figure 6:
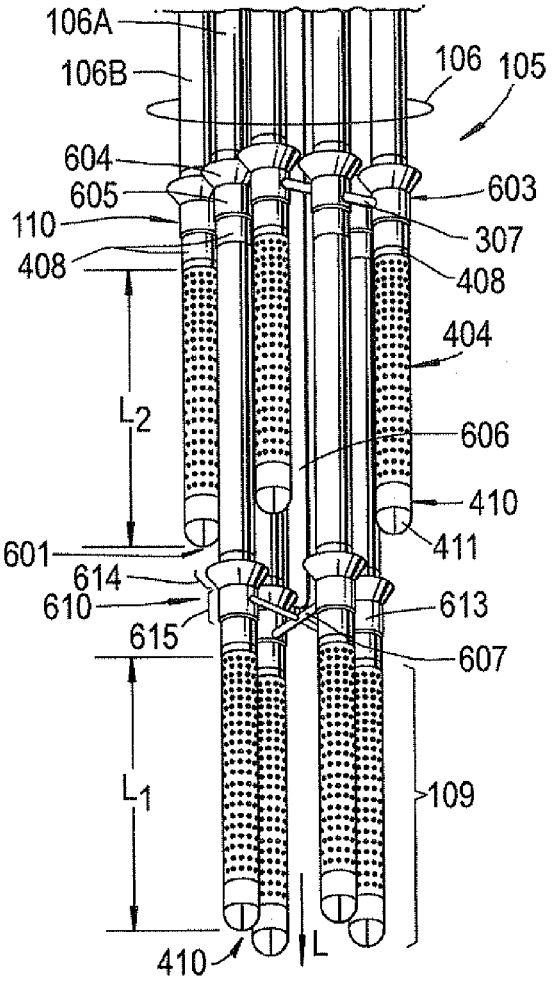

The present invention will now be further illustrated by way of example, and with reference to the accompanying non-limiting drawings, in which:

FIG. 1 schematically shows a floating liquefied natural gas plant provided with a water intake riser assembly comprising a plurality of tubular conduits;

FIG. 2 schematically shows a cross sectional view of the riser assembly at section plane 2 indicated in FIG. 1;

FIG. 3 schematically shows a cross sectional view of the riser assembly at section plane 3 indicated in FIG. 1;

FIG. 3A schematically shows a cross-sectional view of the riser assembly at section plane 3 indicated in FIG. 1 according to another embodiment of the invention;

FIG. 4 schematically shows an example of a distal portion and a part of the connecting portion of one of the tubular conduits;

FIG. 5 schematically shows a bottom view of the distal portion shown in FIG. 4; and FIG. 6 schematically shows a perspective view of the distal part of the water intake riser assembly showing portions of a plurality of tubular conduits when fully suspended.

For the purpose of this description, a single reference number will be assigned to a line as well as a stream carried in that line. The same reference numbers refer to similar components, streams or lines.

The present disclosure describes a water intake riser assembly that is suspendable from an off-shore structure, comprising a bundle of at least a first tubular conduit and a second tubular conduit generally stretching side by side along a length direction, of which at least a part of the distal portion of the first tubular conduit extends further in the length direction than the second tubular conduit when in fully suspended condition.

The tubular conduits in the water intake riser assembly may serve to convey water taken in at the distal portion to the promimal portion. By providing bundle of at least a first tubular conduit and a second tubular conduit of which at least a part of the distal portion of the first tubular conduit extends further in the length direction than the second tubular conduit when in fully suspended condition, the risk of full interruption of water conveyed to the proximal portion due to clogging at the distal part of the water intake riser assembly is reduced.

Firstly, by providing at least two tubular conduits it is achieved that water supply from the distal part of the water intake riser assembly to the proximal part of the water intake riser assembly is still possible if one of the two tubular conduits is blocked at its distal portion from taking in water.

Secondly, by operating the water intake riser assembly with the distal portion of the first tubular conduit extended further in the length direction than the second tubular conduit the risk of both of the two tubular conduits being blocked at the same time (for instance by a single cause) is reduced.

Moreover, by staggering the distal portions of the tubular conduits in the way described, the inflow in each water-intake section of each tubular conduit behaves much more independently since the intake of the neighboring riser (at the same water depth) is further away. Herewith it is achieved that the 'inflow field' per tubular conduit is hardly influenced by the 'inflow field' of other tubular conduit(s) in the bundle.

By such disposal of the distal portion of the first tubular conduit relative to the second tubular conduit, cleaning and/or inspection of the distal portions will also be facilitated.

Clearly the water intake riser assembly may be based on a bundle of more than two tubular conduits, for instance 8 or 9 tubular conduits arranged in a rectangular cross sectional pattern at least having one tubular conduit at each of the four corners and one tubular conduit between sets of two of the corners. Alternatively, the tubular conduits may be arranged in a concentric and/or circular pattern. By increasing the number of tubular conduits, the operational risk of blockage may be further reduced.

FIG. 1 illustrates an example of a marine system 100 in which embodiments of the present invention may be implemented. The marine system 100 in this example includes an off-shore structure 102 on/in a surface of the ocean 104, here represented in the form of a floating structure. The off-shore structure 102 may comprise a Floating Liquefied Natural Gas (FLNG) plant as one example. The FLNG plant may cool and liquefy natural gas, or alternatively heat and vaporize LNG.

A water intake riser assembly 105 is suspended from the off-shore structure 102 in fully suspended condition. The water intake riser assembly 105 may be used to bring water from the ocean to the plant. The water intake riser assembly 105 comprises a bundle 106 of at least a first tubular conduit 106A and a second tubular conduit 106B. These tubular conduits may take in cold water 140 at depth, and convey the cold water upward to the off-shore structure 102. The cold water may be input to heat exchangers to add or remove heat to/from a process performed on the off-shore structure 102. Heated or cooled ocean water from the outlet of the heat exchangers may be discharged back into the ocean at the surface, or alternatively conveyed back to depth with a discharge system.

The first and second tubular conduits 106A,106B generally stretch side by side along a length direction. Seen in the length direction, each of the tubular conduits have a proximal portion 107, followed by a connecting portion 108, followed by a distal portion 109. The distal portions of the tubular conduits together, when fully suspended, form the distal part of the water intake riser assembly. Preferably, the distal part of the water intake riser assembly hangs free from the ocean floor 103. By way of example, the distal part of the water intake riser assembly hangs at a depth D of between around 130 to 170 meters from the surface of the ocean 104, although the water intake riser assembly may be employed at other depths as well.

The proximal portion 107 comprises suspension means by which the tubular conduit is suspended from the off shore structure 102. Due to the ocean current, the tubular structures 106 may deflect from vertical, up to around 40 degrees or so (not shown). To accommodate for such deflection, the tubular structures 106 may be suspended from the off-shore structure through a swivel joint, a ball joint, a riser hanger, or other pivotable or hingeable coupling. Particular reference is made to U.S. Pat. No. 7,318,387 which describes a particularly suitable riser hanger construction involving a flexible load transfer element and a hose to convey the water.

The distal portion 109 comprising a water-intake section, an example of which will be illustrated herein below with reference to FIGS. 4 and 5. The distal portion 109 extends between a first distal end and the connecting portion 108. The connecting portion fluidly connects the proximal portion 107 and the distal portion 109. It can be seen in FIG. 1 that at least part of the distal portion 109 of the first tubular conduit 106A extends further in the length direction than the second tubular conduit 106B.

Only two tubular conduits 106A and 106B have been described so far but the bundle 106 can comprise a larger number. FIG. 2 shows an example approach or configuration for nine tubular conduits (106A to 106I) arranged in a three-by-three rectangular array, according to one particular embodiment. This figure is a cross-sectional view taken along section plane 2 of FIG. 1, through the plurality of tubular conduits. The array has eight tubular structures along the periphery and one at the center. The tubular conduit 106E at the center may serve as a structural support structure for the spacers. The tubular conduit 106E at the center may, or may not, convey water to the surface (i.e., may or may not serve as a water intake riser).

In one particular embodiment, the eight tubular conduits along the periphery may have outer diameters sized d. The structural tubular conduit, in the example the central tubular conduit 106E, may have an outside diameter smaller than d. The eight tubular structures along the periphery may be equally spaced apart by a distance of about one outer diameter d. Thus in this example the tubular conduits (106A to 106I) are positioned on a square grid pattern with a grid spacing of about 2d.

Referring again to FIG. 1, to form the bundle 106, the first and second tubular conduits 106A,106B are laterally connected to each other by means of at least one spacer (110A; 110B, 110C) cooperating with the respective connecting portions 108 of the tubular conduits. By means of such spacers, the tubular conduits are physically associated or connected together. In one embodiment, enough spacers may be provided to keep the tubular structures from striking into one another.

FIG. 3 shows an example spacer 110A for nine tubular conduits (106A to 106I) arranged in the three-by-three rectangular array, according to one particular embodiment. This figure is a cross-sectional view taken along section plane 3 of FIG. 1, through the spacer 110A and the plurality of tubular conduits. The spacers may each comprise one or more a plurality of interconnected guide sleeves 306A to 306D and 306F to 306I, through which respective ones of the tubular conduits 106A to 106D and 106F to 106I are disposed. Bars 307 form the interconnection. At least one of the bars 307 is fixedly connected to the central tubular conduit 106E. In an alternative embodiment, the central tubular conduit 106E also passes through a guide sleeve in which case the spacer 110A should be supported by alternative means such as a rod, a wire, a chain connected to the offshore structure 102.

The guide sleeves are slidingly engaging with the tubular conduit disposed in it. Each guide sleeve 306 may define an aperture 301, which allows one of the elongated tubular conduits to pass freely through it and preferably allows limited rotation of the elongated tubular conduits about a horizontal axis. The horizontal axis is an axis that is lying in a plane of symmetry of the spacer 110A, which plane is perpendicular to the length direction of passage through the aperture 301.

The spacer 110A is slidingly translatable relative to the first and second tubular conduits 106A, 106B along the length direction. This way, the first and second tubular conduits are retractable from the one spacer 110A for instance in case one needs to be replaced.

FIG. 3A shows an alternative embodiment, wherein for nine tubular structures arranged in a concentric array, according to one embodiment. In this case, the concentric array is circular. Alternatively, the array may be elliptical, oval, star shaped, triangular, etc. Furthermore, the bars 307 interconnecting the guide sleeves 306 of the spacer shown in FIG. 3 have been replaced by a frame or by a solid body provided with holes representing the guide sleeves 306 or capable of holding the guide sleeves. This can be applied to rectangular arrays or other bundle patterns as well.

FIG. 4 shows a detailed view of an example of a lower end of one of the tubular conduits 106A, including its distal portion 109 and a part of the connecting portion 108. A guide cylinder 408 may be fitted around a section of the connecting portion 108 to engage with one of the spacers 110. Such a guide cylinder 408 may comprise of a different material than the connecting portion 108. Preferably it is less hard material than the material of the connecting portion 108 and/or the material of the inside of the guide sleeves to ensure that it wears faster than the connecting portion 108 and/or the guide sleeves. The connecting portion may comprise a plurality of pipes connected in a string by connectors 409. The inner diameter of the guide cylinder is suitably snugly fitting to the outer diameter of the tubular connecting portions. The wall thickness of the guide cylinder is suitably between 1.5 and 3 inches, depending on the outer diameter (larger diameter usually corresponding to larger wall thickness).

The water intake section 403 in the distal portion 109 is provided with water intake openings 405 distributed along the water-intake section 403. In embodiments, the connecting portion 108 is free from water intake openings. Preferably, the water-intake section 403 comprises a tubular section having a side wall 404 circumferencing around the length axis L. Herewith a flow passage is defined in the length direction L, with an aperture 402 having a first transverse cross sectional area $A_1$. In the present embodiment, water intake openings 405 are provided as a plurality of through holes through the side wall 404. Each through hole defines a transverse access port into the flow passage and during operation allows a transversely directed flow of cold water 140 from the ocean into the flow passage.

Suitably, the aggregate inlet area defined by flow area through the plurality of through holes 405 is larger than the first transverse cross sectional area $A_1$. Herewith it is achieved that the intake velocity of cold water 140 from the ocean just outside the water intake section 403 can remain below a maximum allowable velocity (in one example the maximum allowable intake velocity is 0.5 m/s) while the water flow velocity inside the tubular conduit can exceed the maximum allowable intake velocity. In preferred embodiments, the aggregate inlet area is larger than 5 times $A_1$. Suitably, the aggregate inlet area is smaller than 50 times $A_1$, preferably smaller than 10 times $A_1$.

By distributing the through holes 405 over a relatively large length along the side wall 404, the diameter at the distal portion may be kept relatively small. Herewith, each of retracting the tubular conduits by sliding them along their length direction is facilitated.

Preferably, the through holes 405 are distributed over the majority of the circumference around the side wall 404. Herewith the concerted effect in the flow field caused by the plurality of water intake sections in the bundle is further reduced, because the through holes 405 can be accessed in a range of a radial directions. As a consequence, the volume of cold water flowing at the highest velocity is relatively low compared to taking in water in a direction along the length direction.

Moreover, the risk of full interruption of water conveyed to the proximal portion 107 due to clogging of the through holes is further reduced if the water intake openings 405 are distributed not only along the length of the water intake section 403 but also over the circumference.

In one particular example, the tubular section of the water-intake section 403 is made of carbon steel with a steel grade of X70 or equivalent thereto. It may have an outer diameter of about 42 inches and wall thicknesses of about 1.5 inch. The through holes 405 may be drilled through the side wall 404. Preferably, each through hole 405 is smaller than 10 cm in diameter to prevent large sea life from entering. Preferably, each through hole 405 is larger than 1 cm in diameter to avoid clogging by build-up of relatively small particulates and to avoid big water pressure differentials. In one example, the diameter of the through holes 405 was selected to be about 5 cm.

Furthermore, the distal portion 109 may comprise a shoe piece 410 at the distal end 401 to provide a rounded tip. In embodiments, the shoe piece 410 may be fitted to the side wall 404 of the distal portion 109. It may comprise a planar piece 411 protruding downwardly from the water intake section with the length direction in its plane. The shoe piece 410 may further comprise a baffle plate 412 extending perpendicularly to the length direction L to avoid intake of water at the lower tubular end of the water intake section 403. If desired, the baffle plate 412 may be provided with one or more smaller through holes 115 to facilitate limited water access to the flow passage 402. These through holes 115 may be of the same or similar size as the through holes 405 in the side wall 404. The planar piece 411 may have a downwardly protruding semi-circular or semi-oval outer contour.

Second and third planar pieces 421 and 431 may be provided as well, as illustrated in FIG. 5 which offers an upward view of the distal end 401 against the length direction. The planar piece 411 together with the second and third planar pieces 421 and 431 may form a crossed arrangement with the plane pieces protruding radially outwardly from a center axis CA defined by the intersection line where the planar pieces meet. More planar pieces may be provided if desired, preferably also radially extending from the centre axis.

FIG. 6 schematically shows a perspective view of the distal part of the water intake riser assembly 105 and showing staggeredly arranged distal portions 109. The example shows a bundle 106 of eight tubular conduits, including the first tubular conduit 106A and the second tubular conduit 106B. The shown portions of all eight tubular elements are of the same design each with the same components. A spacer 110 is fixedly connected to a central support rod 606. The central support rod 606 protrudes downwardly along the length direction and also fixedly supports an auxiliary contportions of an auxiliary spacer 610. The spacer 110 comprises eight guide sleeves 603, but fewer could be installed in other embodiments. The auxiliary space comprises four auxiliary guide sleeves 613 of the same design as the eight guide sleeves 603, interconnected by arms 607.

In this particular example, each guide sleeve 603 comprises an upper portion 604 facing towards the proximal portion of the first and second tubular conduits 106A and 106B, and a lower portion 605 facing towards the distal portion 109 of the first tubular conduit 106A. The lower portion 605 is cylindrically shaped and embracing the first tubular element 106A. The tubular element 106A is optionally provided with a guide cylinder 408 as explained above. The upper portion 604 is funnel shaped, having a wider opening than the cylindrically shaped lower portion 605. The auxiliary guide sleeves 613 have similar upper portion 614 and lower portion 615. This design, preferably in combination with the shoe pieces at the distal ends providing a rounded tip, facilitates reinsertion of the tubular conduit after it has been retracted.

In the example of FIG. 6, the distal portion 109 of four of the eight tubular conduits, including the first tubular conduit 106A, extend further in the length direction L, than the four remaining tubular conduits including the second tubular conduit 106B. Thus, if the distal portion 109 in the first tubular conduit extends between a first distal end 401 and the connecting portion of the first tubular conduit over a length $L_1$, and the distal portion in the second tubular conduit extends between a second distal end 601 and the connecting portion of the second tubular conduit over a length $L_2$, then the first distal end 401 extends at least by an amount of $L_1$ further in the length direction than the second distal end 601. Hence, the distal portions 109 of the first tubular conduit 106A has at least a portion that is in lateral direction (in a plane perpendicular to the length direction) not overlappling with any part of the second tubular conduit 106B.

The total length from the distal end 401 to the lowermost string connector 409 may be in the range of from 5 to 20 m. In one example, this length was about 14 m. The length of the water intake section 403 in one example was 8.5 m and the length of the optional guide cylinder 408 was about 3.4 m.

It should be noted that all tubular conduits in the present example are fully suspended for water intake operation, as opposed to being retracted from the guide sleeves for inspection, replacement or servicing.

To provide sufficient cooling water to the off-shore structure 102, in one embodiment, each of tubular conduit in the bundle may not be necessary to be in operation at any one time. Thus, one or more of the tubular conduits may serve as a surplus water intake riser.

If desired, additional filters may optionally be coupled to each of the distal portions 109.

If desired, more than one of the described water intake riser assemblies may be suspended from a single off shore structure.

Any number of or all of the tubular conduits may be provided with vortex induced vibration suppression means. Examples are described in for instance WO 2010/085302.

The water intake riser assembly as described above may be used to supply process water to any process carried out on the off-shore structure.

In one specific example, it may be used in a method of producing a liquefied hydrocarbon stream, comprising:

feeding a vaporous hydrocarbon containing feed stream to an off-shore structure;

forming a liquefied hydrocarbon stream from at least a part of the vaporous hydrocarbon containing feed stream comprising at least extracting heat from at least said part of the vaporous hydrocarbon containing feed stream;

supplying water to the off-shore structure via the water intake riser assembly;

adding at least part of the heat removed from said at least a part of the hydrocarbon containing feed stream to at least part of the water supplied via the water intake riser assembly;

subsequently disposing of the at least part of the water.

A well known example of a liquefied hydrocarbon stream is a liquefied natural gas stream. A variety of suitable installations and line ups are available in the art for extracting heat from a vaporous hydrocarbon containing feed stream, particularly a natural gas stream, as well as other treatment steps such as removal of unwanted contaminants and components from the feed stream often performed in conjunction with producing a liquefied hydrocarbon stream, and need not be further explained herein.

In another specific example, the water intake riser assembly may be used in a method of producing a vaporous hydrocarbon stream, comprising:

providing a liquefied hydrocarbon stream on an off-shore structure;

forming a vaporous hydrocarbon stream from at least a part of the liquefied hydrocarbon stream comprising adding heat to the said part of the liquefied hydrocarbon stream;

supplying water to the off-shore structure via the water intake riser assembly;

drawing at least part of the heat for adding to the said part of the liquefied hydrocarbon stream from at least part of the water supplied via the water intake riser assembly;

subsequently disposing of the at least part of the water.

A variety of suitable installations and line ups are available in the art for regasification or vaporisation of previously liquefied hydrocarbons streams and adding heat to such a liquefied hydrocarbon stream, and need not be further explained herein.

The person skilled in the art will understand that the present invention can be carried out in many various ways without departing from the scope of the appended claims.

What is claimed is:

1. A water intake riser assembly that is suspendable from an off-shore structure, comprising a bundle of at least a first tubular conduit and a second tubular conduit generally stretching side by side along a length direction, each comprising, seen in the length direction, a proximal portion comprising suspension means, followed by a connecting portion, followed by a distal portion comprising a water-intake section, said distal portion extending between a first distal end and the connecting portion of the respective tubular conduit, said connecting portion fluidly connecting the proximal portion and the distal portion, the first and second tubular conduits being laterally connected to each other by means of at least one spacer engaging the respective connecting portions, wherein at least a part of the distal portion of the first tubular conduit extends further in the length direction than the second tubular conduit when in fully suspended condition.

2. The water intake riser assembly of claim 1, wherein the distal portion in the first tubular conduit extends between a first distal end and the connecting portion of the first tubular conduit over a length $L_1$, and wherein the distal portion in the second tubular conduit extends between a second distal end and the connecting portion of the second tubular conduit over a length $L_2$, wherein the first distal end extends at least by an amount of $L_1$ further in the length direction than the second distal end.

3. The water intake riser assembly of claim 1, wherein the water intake sections are provided with water intake openings distributed along the water-intake sections, and wherein the connecting portions are free from water intake openings.

4. The water intake riser assembly of claim 3, wherein the water intake openings are distributed along the length and the circumference of the water intake sections.

5. The water intake riser assembly of claim 1, wherein the at least one spacer is slidingly translatable relative to the first and second tubular conduits along the length direction, whereby the first and second tubuler conduits are retractable from the at least one spacer.

6. The water intake riser assembly of claim 5, wherein the spacer comprises a guide sleeve slidingly engaging with the first tubular conduit, said guide sleeve comprising an upper portion facing towards the proximal portion of the first and second tubular conduits and a lower portion facing towards the distal portion of the first and second tubular conduits, wherein the lower portion is cylindrically shaped embracing the first tubular element and wherein the upper portion is funnel shaped having a wider opening than the cylindrically shaped lower portion.

7. The water intake riser assembly of claim 1, wherein the water-intake section comprises a tubular section having a side wall circumferencing around the length axis and defining a flow passage in the length direction with an aperture having a first transverse cross sectional area, said side wall being provided with water intake openings in the form a plurality of through holes each defining a transverse access into the flow passage to allow a transversely directed flow of water into the flow passage.

8. The water intake riser assembly of claim 7, wherein an aggregate area defined by the plurality of through holes is larger than the first transverse cross sectional area.

9. The water intake riser assembly of claim 1, wherein the distal portion comprises a shoe piece at the distal end providing a rounded tip.

10. An off-shore structure from which a water riser assembly according to claim 1 is suspended.

11. Method of producing a liquefied hydrocarbon stream, comprising:

feeding a vaporous hydrocarbon containing feed stream to an off-shore structure;

forming a liquefied hydrocarbon stream from at least a part of the vaporous hydrocarbon containing feed stream comprising at least extracting heat from at least said part of the vaporous hydrocarbon containing feed stream;

supplying water to the off-shore structure via a water intake riser assembly according to claim 1;

adding at least part of the heat removed from said at least a part of the hydrocarbon containing feed stream to at least part of the water supplied via the water intake riser assembly;

subsequently disposing of the at least part of the water.

12. Method of producing a vaporous hydrocarbon stream, comprising:

providing a liquefied hydrocarbon stream on an off-shore structure;

forming a vaporous hydrocarbon stream from at least a part of the liquefied hydrocarbon stream comprising adding heat to the said part of the liquefied hydrocarbon stream;

supplying water to the off-shore structure via a water intake riser assembly according to claim 1;

drawing at least part of the heat for adding to the said part of the liquefied hydrocarbon stream from at least part of the water supplied via the water intake riser assembly;

subsequently disposing of the at least part of the water.

* * * * *